US005367722A

United States Patent [19]

Pesterfield

[11] Patent Number: 5,367,722

[45] Date of Patent: Nov. 29, 1994

[54] SPA AND TUB COVER

[75] Inventor: John B. Pesterfield, Cleveland, Tenn.

[73] Assignee: St. John Manufacturing Co., Inc., Cleveland, Tenn.

[21] Appl. No.: 212,557

[22] Filed: Mar. 11, 1994

[51] Int. Cl.[5] ..... E04H 4/10

[52] U.S. Cl. ..... 4/499; 4/580

[58] Field of Search ..... 4/498, 499, 580

[56] References Cited

U.S. PATENT DOCUMENTS

| | | | |
|---|---|---|---|
| 4,422,192 | 12/1983 | Jacobs | 4/498 |
| 4,547,919 | 10/1985 | Wang | 4/499 X |
| 4,857,374 | 8/1989 | Perry | 4/498 X |
| 5,086,525 | 2/1992 | Christopher | 4/498 |

*Primary Examiner*—Robert M. Fetsuga

*Attorney, Agent, or Firm*—Alan Ruderman

[57] ABSTRACT

A cover for spas, hot tubs and the like has a pair of cover portions hinged together along a common top edge. Each cover portion internally has an inflatable air bladder including a series of spaced apart brace members separating each bladder into a number of chambers, each brace member lying in a plane transverse to the axis of the hinge. An elongated pocket is formed in each cover portion adjacent to the hinge and extending in the direction of the hinge. Cross bracing is positionable within each pocket. The cover may be deflated and disassembled for transportation as a small package.

9 Claims, 2 Drawing Sheets

SPA AND TUB COVER

BACKGROUND OF THE INVENTION

This invention relates to a cover for spas, hot tubs or similar pools and the like, and more particularly to a cover of this type which may be folded and collapsed into a small package for shipping and which may provide a rigid top closure.

Spas, hot tubs and similar water tubs or pools have gained substantial popularity in view of the healthful and soothing benefits provided. Covers or lids for such tubs are known so as to close the tub when not being used. This precludes debris from entering the water in the tub, limits the heat loss from the water and protects against the accidental hazards of a child falling into the tub. In the prior art, many of these covers have been bulky, heavy and expensive, being constructed from stiff close cell foam plastic material such as that illustrated in Wendt U.S. Pat. No. 4,236,259. Other covers have been constructed with inflatable bladders so as to be light and flexible. Examples of these are illustrated in Gisondi U.S. Pat. No. 3,533,110; Mosehauer U.S. Pat. No. 3,816,859 and Kingston U.S. Pat. No. 4,606,083.

From this prior art, it may be understood that a spa or hot tub cover should have sufficient strength and rigidity to provide protection against accidental hazards when the cover is in place. The cover should also be light weight and be readily collapsible for storage and for shipping in a small package.

SUMMARY OF THE INVENTION

Consequently, it is a primary object of the present invention to provide a cover for a spa, hot tub and similar water tubs or pools which is light weight, is relatively strong and rigid, and which may be collapsed into a small package for storage and shipping.

It is another object of the invention to provide a cover for a spa, hot tub and similar water tubs or pools which may be inflated to provide a rigid high strength top closure which rests on the upper surface of the tub, the cover being deflated for storage and for transporting in a small package.

It is a further object of the present invention to provide a cover for a spa, hot tub and similar water tubs or pools which may be inflated to provide a rigid high strength top closure for resting on the upper surface of the tub, the cover having fixed internal bracing extending in a first direction and having removable bracing extending in a second direction, the removable bracing selectively being inserted into pockets during use, the cover being deflatable and together with the removable bracing being storable in a small package.

Accordingly, the present invention provides a cover for spas, hot tubs and the like comprising at least a pair of hinged together cover portions, each cover portion having an air bladder including a plurality of spaced apart brace members separating the bladder into a plurality of chambers communicating one with the other. The hinged together portions each have a pocket formed therein adjacent the other cover portion, the pockets extending substantially the entire width of the cover transverse to the brace members, each pocket receiving cross brace means for strengthening the central portion of the cover during use. The peripheral ends of the cover portions are disposed upon and are supported by the top peripheral edges of the spa or tub while the ends of the cross braces are supported on the top of the spa or tub at a central portion thereof. The cross brace means preferably comprises telescoping members which may be disassembled for storage. Thus, the entire cover may be collapsed and stored as a very small package. When used, the bladders are inflated with air and the cross braces are assembled and inserted into the pockets.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
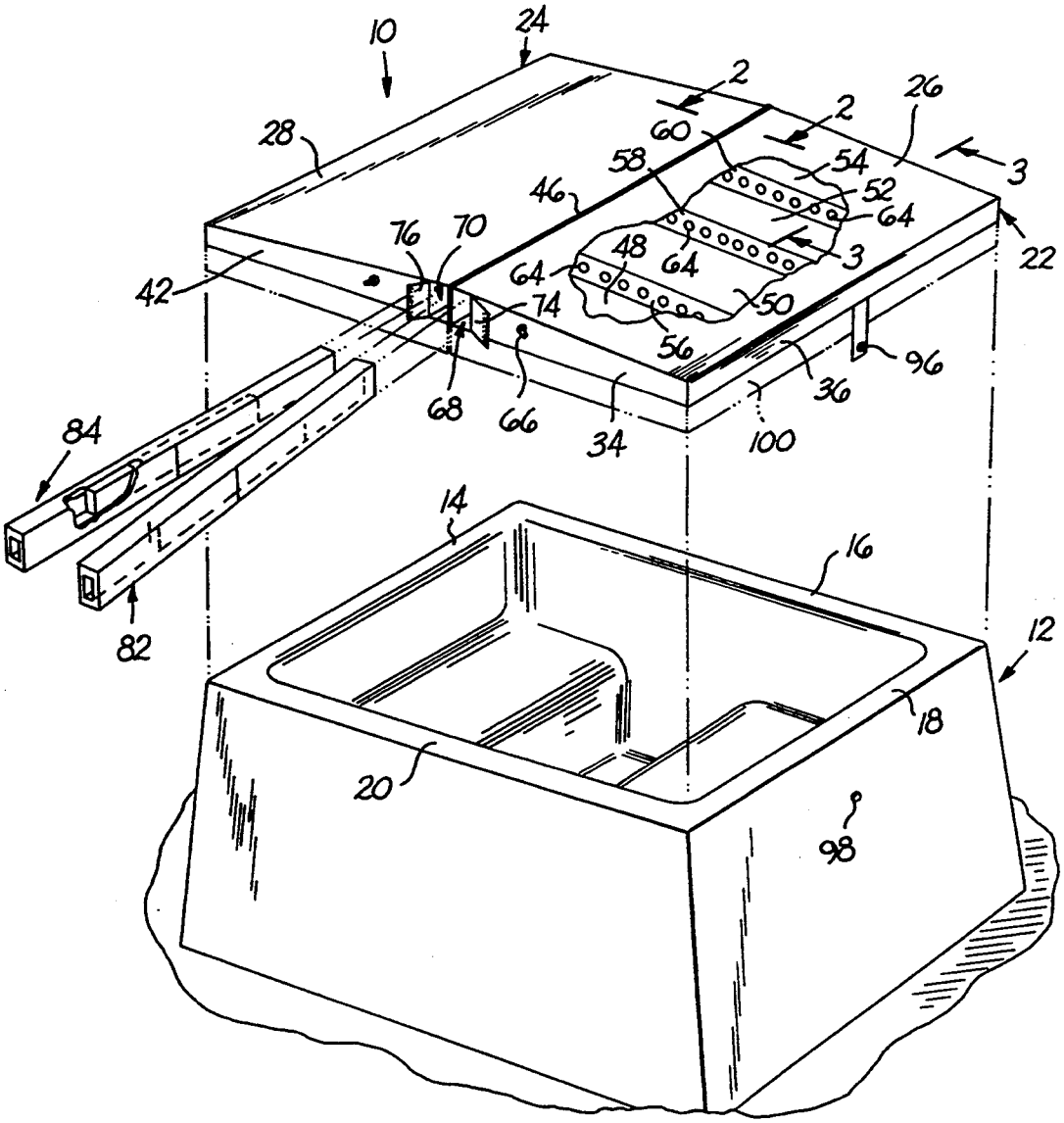
FIG. 1 is an exploded perspective view of a spa cover and a portion of a spa with portions of the cover partially broken away and disassembled from the cover.
Figure 2:
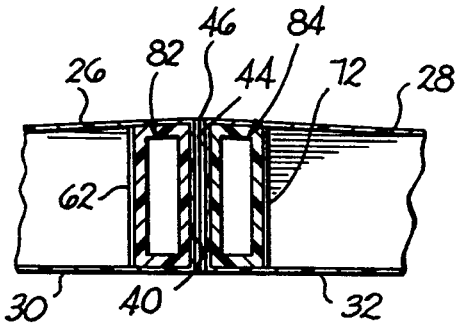
FIG. 2 is a cross sectional view taken substantially along line 2—2 of FIG. 1.
Figure 3:
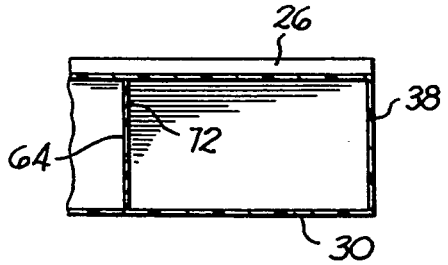
FIG. 3 is a cross sectional view taken substantially along line 3—3 of FIG. 1.

Referring to the drawings, and in particular to FIG. 1, a cover 10 according to the present invention is intended to enclose the top of a conventional spa or hot tub 12 or the like, hereinafter designated as a tub, when disposed on the upper peripheral surfaces 14, 16, 18, 20 of the tub. As illustrated, the tub and the cover are rectangular in form, but in accordance with the principles of the present invention, the peripheral configuration of the tub 12 may be of any conventional form and the peripheral configuration of the cover should conform thereto.

The cover 10, as illustrated in the preferred embodiment, includes a pair of cover portions 22 and 24 each comprising upper and lower plies of material 26, 28 and 30, 32 respectively, the upper and lower plies of each cover portion being joined together by side walls such as the walls, 34, 36, 38 and 40 of the portion 22, the cover portion 24 including similar side walls, only two of which 42 and 44 being illustrated. Preferably, the cover portions 22 and 24 formed from a heat sealable vinyl so that the upper and lower plies may be bonded by heat staking to the respective side walls. Along the upper edges of the respective side walls 40 and 44, the top surface 26 is joined by heat sealing to the top surface 28. Thus, an axially elongated hinge 46 is formed along the junction of the two top surfaces 26, 28 such that, for example, the cover portions may be folded one upon the other with the surface 26 lying upon the surface 28.

The interior of each cover portion 22, 24 forms an air bladder which is divided into a series of bladder chambers or sections such as bladder sections 48, 50, 52, 54, in regard to the cover portion 22, by a series of spaced apart braces 56, 58, 60 heat sealed to the interior of the respective upper and lower surfaces 28, 30 and extending in respective planes transverse to the axis of the hinge 46 from the interior of the wall 36 to an internal wall 62 spaced from and substantially parallel to the wall 40. Each of the braces 56, 58, 60 includes a plurality of apertures 64 spaced apart along the length of the respective brace so that the bladder sections 48, 50, 52, 54 communicate with each other. One of the bladder sections, such as bladder section 48, communicates with a conventional valve member 66 which extends through one of the exterior walls, such as wall 34, which comprises a wall forming that bladder section. When the cover is to be used, air may be blown through the valve 66 by a pump or by the mouth of a person in a manner similar an inner tube or pool float, and into the bladder 48. Since the bladder sections 48, 50, 52, 54 communicate through the apertures 64 in the braces 56, 58, 60, the air flows from the bladder section 48 to the other bladder sections to inflate the cover portion 22. The cover portion 24 has substantially the same structure as that of the cover portion 22 and it is inflated in the same manner.

Figure 5:
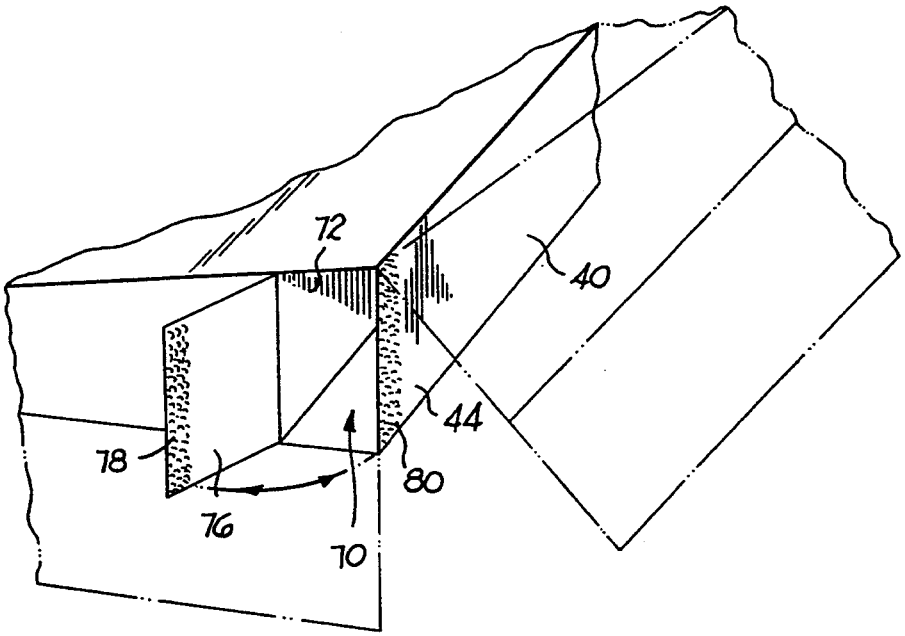
FIG. 5 is a fragmentary perspective view of the closure means for a cross brace receiving pocket.

With both cover portions 22, 24 inflated, the cover may be positionable upon the surfaces 14, 16, 18, 20 of the tub 12. The internal braces 56, 58, 60 provide a rigid structural support to the respective cover portions in the direction transverse to the direction in which the braces extend. In order to provide a rigid structural support in the central area of the cover in the direction substantially parallel to the braces, the present invention provides a respective strengthener receiving elongated pocket 68, 70 in each cover portion 22, 24 adjacent the hinge 46. The pocket 68 is formed between the upper and lower surfaces 26, 30, the side wall 40 and the internal wall 62 of the cover portion 22, while the pocket 70 is similarly formed between the upper and lower surfaces 28, 32, the side walls 44 and an internal wall 72 similar to the walls 62 but within the cover portion 24. Each pocket includes a respective flap or door 74, 76 which, as illustrated in FIG. 5 in regard to the door 76, has half of a hook and loop fastener member 78, such as that sold under the VELCRO trademark, on the interior face thereof, the complementary other half of the hook and fastener member 80 is disposed on the wall 44 adjacent the opening to the pocket 70. To close the pocket a flap or door is moved into superposed relationship with the pocket opening and the fastener members 78, 80 are engaged. Of course, any other convenient fasteners may be employed in place of the hook and loop fastener.

Figure 4:
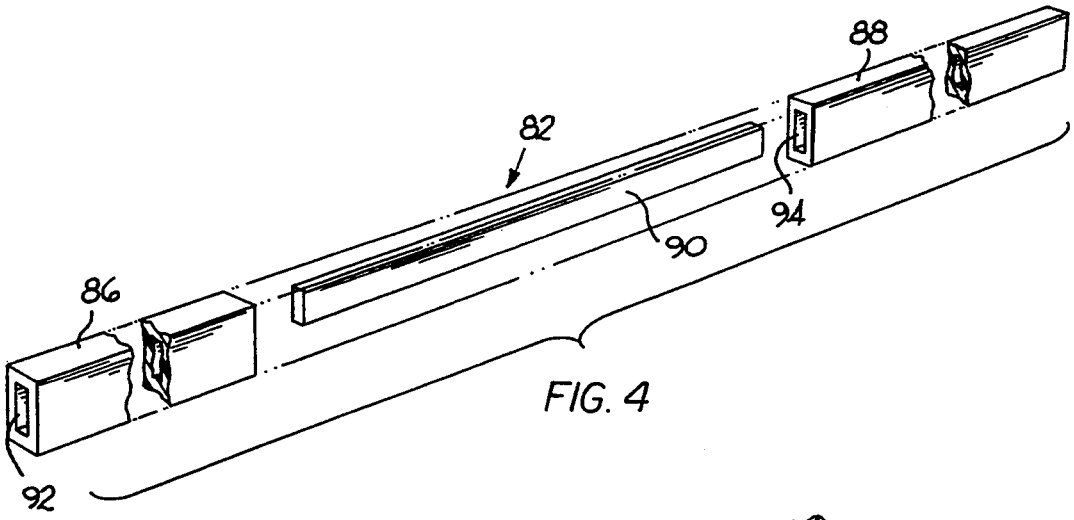
FIG. 4 is a perspective view of the cross bracing for a cover portion illustrated in FIG. 1 with portions thereof partially broken away.

Positionable within each respective pocket 68, 70 is cross bracing means 82, 84 which may be inserted or removed selectively from the respective pocket. As best illustrated in FIG. 4 in regard to the cross bracing means 82, each cross bracing means comprises first and second hollow brace members 86, 88 of a length such that each may extend approximately half of the width of the cover portions in the direction of the pockets 68, 70. A smaller connecting member or stiffener 90, which may or may not be hollow, is telescopically receivable within the hollow bores 92, 94 of the respective brace members 86, 88 so as to selectively connect the brace members 86, 88 together in a rigid manner. The three members 86, 88 and 90 when connected together in this fashion thereafter may be inserted into each respective pocket 68, 70 to provide the structural rigidity as aforesaid. Preferably the cross bracing members and the stiffener have a substantially rectangular configuration as illustrated, although other convenient shapes are contemplated by the present invention. It is anticipated that the cross bracing members 86, 88 and the stiffener 90 may be formed as extrusions from polyvinyl chloride (PVC) plastic material.

When the cover is to be transported or shipped after manufacture, and if it is to be stored and held for a long period before use, the cover portions will be in the deflated state so that they may be folded into a relatively small package. At this time the cross brace members 86, 88 and the stiffener 90 are disassembled from each other and are not installed within the pocket. Thus, these members also may be disposed within the package with the cover portions. In use, the cover portions 22, 24 are inflated as aforesaid and positioned on top of the tub 12. The cross brace means 82, 84 after assembly of the components, are thereafter inserted into the respective pockets. Preferably each cover portion includes a connector member such as a snap or the like 96 extending downwardly therefrom and adapted to cooperate with a complementary member 98 on the side of the tub 12 so as to secure the cover to the tub when the tub is not in use. Also a skirt 100 may extend from the bottom of the cover portions, the skirt fitting about the upper portion of the tub 12. To store the cover when the tub is in use, after the connecting members are disassembled from the tub, one cover portion will be folded onto the other about the hinge 46 so that the upper surfaces 26, 28 are superposed one upon the other.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A cover for providing a closure for the top of a water tub, comprising a pair of cover portions having upper and lower external surfaces, hinge means pivotably connecting one of said upper and lower surfaces of said cover portions together for pivoting one cover portion relative to the other cover portion about a pivot axis, each cover portion having an inflatable bladder intermediate the respective upper and lower surfaces, a plurality of brace members disposed within each bladder separating each bladder into a plurality of bladder chambers for strengthening and providing rigidity to each cover portion transverse to said brace members, each of said brace members being disposed in a plane transverse to said pivot axis, each of said brace members including a plurality of apertures for communicating adjacent bladder chambers together, and valve means communicating at least one bladder chamber of each cover portion with the exterior of the respective cover portion for inflating the bladders of each cover portion with air and for deflating each cover portion selectively.

2. A cover as recited in claim 1, wherein each cover portion includes an elongated pocket disposed adjacent to said hinge means and extending in a direction substantially parallel to said pivot axis, and bracing means disposed within each pocket for strengthening and providing rigidity to said cover portions transverse to said bracing means.

3. A cover as recited in claim 2, wherein each bracing means comprises a pair of hollow braces, and a connecting member telescopically received within the hollow of each pair of braces for connecting the pair of braces together.

4. A cover as recited in claim 2, wherein each pocket includes an access entrance for receipt and removal of said bracing means, and door means for selectively opening and closing said access entrance.

5. A cover as recited in claim 4, wherein each bracing means comprises a pair of hollow braces, and a connecting member telescopically received within the hollow of each pair of braces for connecting the pair of braces together.

6. A cover as recited in claim 4, wherein said brace members are substantially perpendicular to said bracing means.

7. A cover as recited in claim 2, wherein said brace members are substantially perpendicular to said bracing means.

8. A cover as recited in claim 7, wherein each bracing means comprises a pair of hollow braces, and a connecting member telescopically received within the hollow of each pair of braces for connecting the pair of braces together.

9. A cover as recited in claim 8, wherein each pocket includes an access entrance for receipt and removal of said bracing means, and door means for selectively opening and closing said access entrance.

* * * * *